United States Patent [19]

Kawamura et al.

[11] Patent Number: 4,816,348

[45] Date of Patent: Mar. 28, 1989

[54] SURFACE TREATED STEEL SHEET FOR WELDED CAN MATERIAL

[75] Inventors: Hiroaki Kawamura; Masanobu Matsubara; Osamu Yoshioka; Tsuneo Inui, all of Yamaguchi, Japan

[73] Assignee: Toyo Kohan Co., Ltd., Tokyo, Japan

[21] Appl. No.: 100,560

[22] Filed: Sep. 24, 1987

Related U.S. Application Data

[63] Continuation-in-part of Ser. No. 829,816, Feb. 14, 1986, abandoned.

[51] Int. Cl.[4] ..... B32B 15/18

[52] U.S. Cl. ..... 428/629; 428/648; 428/667; 428/687

[58] Field of Search ..... 428/627, 648, 666, 667, 428/684, 935, 687; 220/456, 457, 458, 62, DIG. 11

[56] References Cited

U.S. PATENT DOCUMENTS

| | | | |
|---|---|---|---|
| 4,421,828 | 12/1983 | Alloue et al. | 428/648 |
| 4,501,802 | 2/1985 | Aiguchi et al. | 428/648 |
| 4,579,786 | 4/1986 | Nakakouji et al. | 428/648 |
| 4,601,957 | 7/1986 | Fujimoto et al. | 428/648 |

FOREIGN PATENT DOCUMENTS

| | | | |
|---|---|---|---|
| 25396 | 3/1981 | European Pat. Off. | 428/648 |
| 100285 | 6/1984 | Japan | 428/648 |
| 145794 | 8/1984 | Japan | 428/648 |
| 184688 | 9/1985 | Japan | 428/648 |

*Primary Examiner*—John J. Zimmerman

*Attorney, Agent, or Firm*—Wenderoth, Lind & Ponack

[57] ABSTRACT

A surface treated steel sheet having double layers consisting of a lower layer of metallic chromium and an upper layer of hydrated chromium oxide are formed on a low tin plated steel sheet in which 30 to 80% of the surface of the steel sheet is covered with plated tin. Also, the ratio of the area of tin, which actually combined with steel sheet, to the projected area of plated tin to the steel sheet is 20 to 90% and the size of the exposed steel surface units, after tinplating, is 0.5 to 20 μm in diameter when expressing the irregularly exposed areas as circles, and a method for production of this surface treated steel sheet which comprises; (a) electroplating with a small amount of tin under restricted conditions in order to obtain the low tin plated steel sheet described above, (b) after reflowing or without reflowing of the plated tin, formation of said double layer or formation of the metallic chromium layer followed by formation of hydrated chromium oxide under restricted conditions.

This surface treated steel sheet is suitable for producing a welded can body without removing the plated layer at high speed, since it is excellent in weldability, lacquer adhesion and corrosion resistance after lacquering.

5 Claims, 4 Drawing Sheets

SEM

1μm

Sn-Kα

1μm

Sn-Kα

SEM

1μm

Sn-Kα

1μm

Sn-Kα

SURFACE TREATED STEEL SHEET FOR WELDED CAN MATERIAL

This is a continuation-in-part of now abandoned Ser. No. 829,816, filed Feb. 14, 1986, now abandoned.

FIELD OF THE INVENTION

The present invention relates to a surface treated steel sheet being excellent in weldability, lacquer adhesion and corrosion resistance after lacquering and a method for its production. In detail, the present invention relates to a surface treated steel sheet having double layers consisting of a lower layer of metallic chromium and an upper layer of hydrated chromium oxide on a low tin plated steel sheet which is characterized by the state of plated tin, and a method for production of this surface treated steel sheet which is characterized by an electroplating with a small amount of tin on a steel sheet under restricted conditions and by the formation of a metallic chromium layer and hydrated chromium oxide layer on a low tin plated steel sheet under restricted conditions.

By using this surface treated steel sheet, a welded can body can be easily produced at high speed without removing the plated layer, in spite of the presence of a double layer consisting of metallic chromium and hydrated chromium oxide on a low tin plated steel sheet.

BACKGROUND AND OBJECTIVE

Generally, the seaming of a can body in a three piece can consisting of two can ends and a single can body is carried out by soldering, adhesion with a nylon adhesive and electric welding.

Recently, electric welding has been widely used for the seaming of the tinplate can body in the field of food cans, aerosol cans and miscellaneous cans, instead of soldering with a solder of regulated lead content. In the seaming of the tinplate can body, it is desirable to decrease the tin coating weight in tinplate, because tin used for the production of tinplate is very expensive. However, the weldability of tinplate gradually becomes poor with a decrease of the tin coating weight.

From the background described above, the development of a welded can material, which is cheaper than conventional electrotinplate, is easily welded without removing the plated layer at high speed and is excellent in lacquer adhesion and corrosion resistance after lacquering, has been required in the field of food cans.

Within the last few years, various surface treated steel sheets have been proposed as welded can materials having the characteristics described above. For instance, low tin plated steel sheet (LTS) with below about 1000 mg/m$^2$ of tin which is reflowed or unreflowed after tinplating has been proposed. However, this LTS has a narrower current range for sound welding than that for tinplate. The reason is considered to be that the amount of free metallic tin in this LTS is smaller than that in tinplate and also further decreases because of the change of plated free metallic tin to iron-tin alloy by heating for lacquer curing or reflowing after tinplating. For the improvement in the weldability of this LTS, the following three methods have been proposed. The first method is one in which a steel sheet is plated with a small amount of nickel before tinplating. In this method, a decrease in the amount of plated free metallic tin, that is, the change of plated metallic tin to iron-tin alloy by heating for lacquer curing, is suppressed because a dense nickel-tin alloy layer formed during aging at room temperature or a dense iron-tin alloy containing nickel formed by reflowing after tinplating, acts as a barrier for the diffusion of iron to plated tin. The second method is one in which nickel is plated on a steel sheet before annealing and then all or a part of the plated nickel is diffused on the surface of the steel sheet by heating for the annealing of the steel sheet, after which a small amount of tin is plated on the steel sheet covered with a nickel diffusion layer. The third method is one in which tin is plated on a steel sheet before annealing, instead of nickel in the second method.

In the second and third methods, a nickel diffusion layer or an iron-tin alloy layer formed on the steel sheet by heating for the annealing of the steel sheet acts as a barrier for the change of the plated metallic tin to iron-tin alloy by heating for the lacquer curing or reflowing after tinplating.

Although the weldability and the corrosion resistance after lacquering of the LTS by these methods described above are improved, the excellent lacquer adhesion required for a can material is not obtained. The reason is considered to be that the surface of the LTS is oxidized during aging in an ordinary atmosphere because the surface of the LTS is not sufficiently covered with the film formed by an electric chromic acid treatment. If the surface of the LTS is sufficiently covered with this film, the weldability becomes poor, although the lacquer adhesion of the LTS may be improved.

Accordingly, it is the first objective of the present invention to provide a surface treated steel sheet having excellent weldability, excellent lacquer adhesion and excellent corrosion resistance after lacquering for a welded can material.

It is the second objective of the present invention to provide a method for the continuous production of a surface treated steel sheet having excellent characteristics as described above.

BRIEF DESCRIPTION OF THE INVENTION

The first objective of the present invention can be accomplished by providing a surface treated steel sheet having double layers consisting of a lower layer of metallic chromium and an upper layer of hydrated chromium oxide on a low tin plated steel sheet in which 30 to 80% of the surface of the steel sheet is covered with plated tin and an effective diameter of an irregularly shaped unplated area, which is defined as the diameter of a circle having the identical area, is controlled between 0.5 and 20 μm. Also, the ratio of the area of tin, which actually combined with steel sheet, to the projected area of plated tin to the steel sheet is 20 to 90%.

The second objective of the present invention can be accomplished by an electroplating with a small amount of tin on a steel sheet under special electroplating conditions which is characterized by a lower current density and lower amount of additives in the tinplating electrolyte compared with those in conventional electrotinplating and by the deposition of metallic chromium on plated tin and the exposed area of steel sheet which is not plated with tin under special conditions which is characterized by a cathodic electrolysis under higher current density regulated by cathodic potential for the electrodeposition of metallic chromium on said tin plated steel sheet.

It is a very important point and an inventive feature in the present invention that the exposed steel surface lies scattered after tinplating and metallic chromium is positively deposited on the surfaces of plated tin and the exposed steel which is not plated with tin, and furthermore that the surface of the metallic chromium is uniformly covered with a hydrated chromium oxide layer. That is to say, it is considered that the surface treated steel sheet according to the present invention is a hybrid of a tin free steel (TFS) wherein a steel sheet is covered with double layers consisting of a lower layer of metallic chromium and an upper layer of hydrated chromium oxide and a tin plated steel sheet, in which demerits are removed and merits are retained in both surface treated steel sheets.

The surface treated steel sheet according to the present invention can be used in applications wherein excellent weldability, i.e. easily being welded without the removal of the plated layer at high speed, is required, such as food can bodies, and aerosol can bodies which are lacquered, except for the welded part before welding. Furthermore, the surface treated steel sheet of the present invention can also be used in applications wherein excellent lacquer adhesion and excellent corrosion resistance after lacquering are required such as can ends, drawn cans and drawn and redrawn cans (DR cans), besides can bodies.

DETAILED DESCRIPTION OF THE INVENTION

The steel sheet used for the production of the surface treated steel sheet according to the present invention can be any cold rolled steel sheet customarily used in manufacturing electrotinplate and TFS. Preferably, the thickness of the steel sheet is from 0.1 to about 0.35 mm.

The surface treated steel sheet according to the present invention is produced by the following processes:

(1) degreasing with an alkali and pickling with an acid→water rinsing→tinplating under special conditions→water rinsing→chromium plating under special conditions→water rinsing→formation of hydrated chromium oxide→water rinsing→drying or (2) degreasing with an alkali and pickling with an acid→water rinsing→tinplating under special conditions→water rinsing→simultaneous formation of metallic chromium and hydrated chromium oxide under special conditions→water rinsing→drying. In both methods reflowing after tinplating may be carried out. Furthermore, water rinsing after chromium plating may be omitted in method (1).

In the surface treated steel sheet according to the present invention, the state of tin plated on a steel sheet is very important.

30 to 80% of the surface of the steel sheet should be covered with plated tin and an effective diameter of an irregularly shaped unplating area, which is defined as the diameter of a circle having the identical area, is controlled between 0.5 and 20 μm, more preferably 1 to 10 μm in diameter when expressing the exposed areas as circles. Also, the ratio of the area of tin, which actually combined with steel sheet, to the projected area of plated tin to the steel sheet is 20 to 90%.

In the case where above 80% of the surface of the steel sheet is covered with plated tin or the size of the exposed steel surface is below 0.5 μm in diameter, weldability and lacquer adhesion are not improved because the greater part of the surface of the steel sheet is covered with plated tin and the greater part of the plated tin changes to iron-tin alloy by heating for lacquer curing or reflowing after tinplating. If the size of the exposed steel surface after tinplating is above 20 μm in diameter, the exposed steel surface units become continuous and a greater part of the plated tin becomes a granular deposit of 0.1 to 1 μm in diameter. As a result plated tin is easily peeled off from the surface of the steel sheet. If the surface of the steel sheet covered with plated tin is below 30%, excellent weldability is not obtained, particularly in the case of a small amount of plated tin.

Also, in the case of tin plated steel sheet obtained by the present application, the area of tin, which actually combined with steel sheet is small compared with the projected area of plated tin to the steel sheet. It is clear that the above mentioned fact affects the improvement of weldability.

In general, the weldability of tin plated steel sheet becomes good with an increase in the amount of metallic tin remaining after baking of lacquer curing.

The amount of metallic tin remained after baking varies inversely as that of Fe-Sn alloy, which is formed at the interface between the deposited tin and steel surface on the tin plated steel sheet.

In case the area of tin, which actually combined with steel sheet is small compared with the projected area of plated tin to the steel surface, the formation of Fe-Sn alloy is suppressed and the amount of metallic tin remaining after baking is increased compared with the other case.

Therefore, the ratio of the area of tin, which actually combined with steel sheet to the projected area of plated tin to the steel sheet is 20 to 90%.

In the case of the ratio over 90%, the improvement of the weldability of the tin plated steel sheet is not recognized.

In the case of the ratio under 20%, because the adhesion strength of the interface between the deposited tin and steel surface is low, the tin plated steel sheet is peeled off from above the interface.

Tin coating weight is also one of the important factors in the surface treated steel sheet according to the present invention. The optimum range of the tin coating weight is from 50 to 900 mg/m$^2$, more preferably 100 to 600 mg/m$^2$. At below 50 mg/m$^2$ of tin coating weight, excellent weldability is not obtained because the amount of metallic tin decreases remarkably by the change to iron-tin alloy by heating for lacquer curing or reflowing after tinplating.

At above 900 mg/m$^2$ of plated tin, lacquer adhesion becomes poor as with electrotinplate because the greater part of the steel surface is uniformly covered with plated tin, although excellent weldability is obtained.

In order to obtain the tin plated steel sheet having features described above, the steel sheet is plated with tin under the following conditions after degreasing with an alkali and pickling with an acid:

Tinplating electrolyte
Stannous phenolsulfonate bath or stannous sulfate bath
Concentration of stannous ion 30 to 80 g/l
Concentration of acid as sulfuric acid 15 to 60 g/l
Concentration of additives 0.2 to 2 g/l
Temperature of the electrolyte 40° to 60° C.
Cathodic current density 2 to 10 A/dm$^2$ Generally, in the case that tinplating electrolyte having higher concentrations of stannous ion, acid and additives is used, a higher current density and higher temperature of the electrolyte should be selected. On the contrary, in lower concentrations of stannous ion, acid and additives, lower current density and lower temperature should be selected in order to insure that the exposed steel surface of the tin plated steel sheet lies scattered after tinplating. However, even if tinplating is carried out under the conditions limited in the present invention, an increase in the amount of plated tin leads to a decrease in the exposed steel surface after tinplating. Therefore, it is indispensable in the present invention that the amount of plated tin is maintained below 900 mg/m$^2$. In the tinplating conditions described above, the range of current density and the range in the concentration of additives in the tinplating electrolyte are particularly important factors for the production of the surface treated steel sheet according to the present invention.

The concentration of additives below 0.2 g/l is not suitable in the present invention because the adhesion of plated tin to the steel sheet becomes poor and plated tin is easily peeled off from the surface of the steel sheet. At above 2 g/l in the concentration of additives, excellent weldability and excellent lacquer adhesion are not obtained because the greater part of the steel surface is uniformly covered with plated tin. Above 10 A/dm$^2$ of current density is not preferable in the present invention for the formation of a uniform plated tin layer on the steel sheet. A current density below 0.2 A/dm$^2$ is not suitable for high speed production of the surface treated steel sheet according to the present invention.

In the case of the tinplated steel sheet electrolyzed beyond the limits of the conventional tinplating condition, the non-uniform deposition of tin occurs on the steel sheet and the area of tin, which actually combined with steel sheet is small compared with the projected area of plated tin to the steel sheet.

Generally, the deposition of tin occurs more easily on a tin layer than on a steel surface.

Considering the tin plating of the present application, tin is deposited partially on the steel surface at the initial step in the tin plating process, and then tin is continuously deposited on the previous deposited tin due to the electrochemical considerations, resulting in the large area of tin compared with the area of tin in the initial step.

The above facts are explained by FIGS. 1 to 6.

FIG. 1 shows the scanning electromicrograph of the plated granular tin obtained by U.S. Pat. No. 4,579,786 with a masking sheet.

FIG. 2 shows the Sn-K$\alpha$ image of the granular tin shown in FIG. 1.

FIG. 3 shows the Sn-K$\alpha$ image of Fe-Sn alloy of the same position shown in FIG. 1 after baking at 180° C. for 5 minutes.

Considering that there is not a remarkable difference between FIG. 2 and FIG. 3, it is clear that almost all of the metallic tin of the tin plated steel sheet obtained by U.S. Pat. No. 4,579,786 changes to Fe-Sn alloy by baking.

FIG. 4 shows the scanning electromicrograph of the tin plated steel sheet obtained by the present application.

FIG. 5 shows the Sn-K$\alpha$ image of tin plated steel sheet shown in FIG. 4.

FIG. 6 shows the Sn-K$\alpha$ image of Fe-Sn alloy of the same position shown in FIG. 4 after baking at 180° C. for 5 minutes.

From the comparison between FIG. 5 and FIG. 6, it is clear that the area of Fe-Sn alloy shown in FIG. 6 is smaller than that of tin.

Considering that the alloying between the iron and tin occurs at the interface between the deposited tin and steel surface on the tin plated steel sheet, it is clear on the tin plated steel sheet obtained by the present application that the area of tin, which actually combined with steel sheet is small compared with the projected area of plated tin to the steel sheet.

The particular shape of the deposited tin obtained by the present application improves the weldability.

As the result, the weldability of the tin plated steel sheet obtained by the present application is superior to that of U.S. Pat. No. 4,579,786.

In the present invention, an $\alpha$-naphthol additive such as ethoxylated $\alpha$-naphthol and ethoxylated $\alpha$-naphthol sulfonic acid, which are used as additives in tinplating electrolyte for the production of conventional electrotinplate, are suitable.

The tin plated steel sheet produced under the conditions described above is covered with metallic chromium layer and hydrated chromium oxide layer. The amount of metallic chromium and hydrated chromium oxide formed on the tin plated steel sheet are also important factors in the present invention. The amount of metallic chromium should be controlled in the range of 7 to 100 mg/m$^2$, more preferably 20 to 70 mg/m$^2$. If the amount of metallic chromium is below 7 mg/m$^2$, the surface treated steel sheet being excellent in weldability, lacquer adhesion and corrosion resistance after lacquering is not obtained because the surfaces of plated tin and the exposed steel which is not plated with tin are not sufficiently covered with deposited metallic chromium. At above 100 mg/m$^2$ of metallic chromium, weldability becomes poor, although the corrosion resistance after lacquering is improved, if the surface of metallic chromium is uniformly covered with hydrated chromium oxide.

The optimum range of hydrated chromium oxide formed on the metallic chromium layer is 5 to 50 mg/m$^2$ as chromium, more preferably 7 to 30 mg/m$^2$ as chromium.

If the amount of hydrated chromium oxide formed on the metallic chromium layer is below 5 mg/m$^2$, the corrosion resistance after lacquering and the lacquer adhesion become poor, although the weldability is excellent, because the surface of the metallic chromium layer is not sufficiently covered with the formed hydrated chromium oxide. It is not also preferable that the amount of hydrated chromium oxide is above 50 mg/m$^2$ as chromium because the weldability becomes remarkably poor by an increase of hydrated chromium oxide which has high electric resistance.

For the formation of a double layer consisting of a lower layer of metallic chromium and an upper layer of hydrated chromium oxide or metallic chromium layer followed by the formation of hydrated chromium oxide layer on the tin plated steel sheet obtained under the conditions described above, the following two methods, which are used for the production of TFS, are utilized. One is a two step process in which metallic chromium is plated by a cathodic electrolysis in a known chromium plating electrolyte such as a Sargent bath or a highly concentrated chromic acid electrolyte containing additives such as fluorine compounds and sulfur compounds and then hydrated chromium oxide is formed on the metallic chromium layer by a cathodic electrolysis in a dilute concentrated chromic acid electrolyte containing additives described above. The other is a one step process in which said double layer is simultaneously formed on the tin plated steel sheet by a cathodic electrolysis in a dilute concentrated chromic acid electrolyte containing additives described above.

However, the conditions for the electrodeposition of metallic chromium in the one step process or two step process are very important in the present invention. Namely, it is indispensable in the present invention that the electrode potential of the tin plated steel sheet in the chromic acid electrolyte used for the electrodeposition of metallic chromium is kept to less noble potential than that for the deposition of metallic chromium from chromic acid.

Therefore, it is preferable that the tin plated steel sheet is potentiostatically electrolyzed at a less noble potential than that for the deposition of metallic chromium from chromic acid. However, conventional electrotinplate and TFS are industrially produced by a galvanostatic electrolysis. If the tin plated steel sheet is galvanostatically electrolyzed under a cathodic current density in which the electrode potential of the tin plated steel sheet is kept noble with respect to that for the deposition of metallic chromium, the surface treated steel sheet having excellent weldability, excellent lacquer adhesion and excellent corrosion resistance after lacquering is not obtained because a large amount of hydrated chromium oxide containing a little amount of metallic chromium is formed on the tin plated steel sheet.

The phenomenon described above is theoretically explained by using FIG. 7. FIG. 7 shows cathodic polarization curves of steel sheet and tin sheet by potentiostatic electrolysis in which steel sheet and tin sheet are polarized to a less noble potential from the rest potential of each sheet at 50 mV/min of polarization speed in an aqueous solution consisting of 50 g/l of chromic acid, 0.5 g/l of sulfuric acid and 5 g/l of sodium fluoride under 120 m/min of flow speed of the solution at a 50° C. solution temperature.

It is found from FIG. 7 that metallic chromium is deposited at less noble potential than −1.0 V versus Saturated Calomel Electrode (vs SCE) and the formation and the dissolution of hydrated chromium oxide is repeated in −0.8 to −1.0 V vs SCE on the steel sheet and the tin sheet, and furthermore the current density on the tin sheet shown in −0.8 to −1.0 V vs SCE of the potential range is remarkably larger than that on the steel sheet. In the case of potentiostatic electrolysis, it is possible to deposit metallic chromium on the steel sheet and the tin sheet, if the electrode potential of the steel sheet and the tin sheet is kept to a less noble potential than −1.0 V vs SCE in the chromic acid solution described above. However, it is found from FIG. 7 that metallic chromium is deposited on the steel sheet, but hydrated chromium oxide is formed on the tin sheet without the deposition of metallic chromium, if the steel sheet and the tin sheet are galvanostatically electrolyzed under the same cathodic current density of 30 $A/dm^2$, because the electrode potential of the steel sheet is kept to about −1.5 V vs SCE but that of the tin sheet moves to −0.8 to −1.0 vs SCE. The behavior of the tin plated steel sheet is the same as the tin sheet. Therefore, the tin plated steel sheet should be electrolyzed under above 30 $A/dm^2$ of cathodic current density for the deposition of metallic chromium on the tin plated steel sheet.

Generally, current density for the reduction of chromic acid at −0.8 to −1.0 V vs SCE increases with increases in the concentration of chromic acid, temperature of chromic acid solution and the flow speed of the solution. For instance, the tin plated steel sheet should be electrolyzed under above 50 $A/dm^2$ for the deposition of metallic chromium on the tin plated steel sheet, if the concentration of chromic acid in the electrolyte increases to 250 g/l at the same temperature and the same flow speed of the electrolyte as shown in FIG. 7.

Therefore, it is indispensable in the present invention that the tin plated steel sheet in which the exposed steel surface lies scattered after tinplating is galvanostatically electrolyzed under the larger current density than that shown when the electrode potential of the tin plated steel sheet is kept at −0.8 to −1.0 V vs SCE in the chromic acid electrolyte used for the deposition of metallic chromium.

Particularly, in the case of simultaneous formation of metallic chromium and hydrated chromium oxide on the tin plated steel sheet by using a one step process used for the production of TFS, the conditions for the deposition of metallic chromium should be preferentially decided from the electrode potential of the tin plated steel sheet in the chromic acid electrolyte; after that, the amount of hydrated chromium oxide should be controlled.

In the present invention, it is preferable to employ the following electrolytic chromium plating conditions for the formation of a metallic chromium layer on a tin plated steel sheet by using a one step method or a two step method:

Concentration of chromic acid: 30 to 300 g/l, more preferably 30 to 100 g/l in the one step method and 100 to 300 g/l in the two step method.

Concentration of $SO_4^{2-}$ and F− in additives: 1.0 to 5.0 weight %, more preferably 1.0 to 3.0 weight % of the concentration of chromic acid.

Additives: at least one compound selected from the group consisting of fluorine compounds, such as hydrofluoric acid, fluoboric acid, fluosilicic acid, ammonium bifluoride, an alkali metal bifluoride, ammonium fluoride, an alkali metal fluoride, ammonium fluoborate, an alkali metal fluoborate, ammonium fluosilicate, an alkali metal fluosilicate, aluminum fluoride and sulfur compounds such as sulfuric acid, ammonium sulfate, an alkali metal sulfate, chromium sulfate, ammonium sulfite, an alkali metal sulfite, ammonium thiosulfate, an alkali metal thiosulfate.

Temperature of the electrolyte: 30° to 60° C.

Cathodic current density: higher than that shown when the electrode potential of the tin plated steel sheet is kept to −0.8 to −1.0 V vs SCE in the chromic acid electrolyte described above.

Generally, the amount of hydrated chromium oxide formed during chromium plating decreases with an increase in the concentration of chromic acid in a suitable weight ratio of additives to chromic acid. It is not preferable to use an electrolyte having below 30 g/l of chromic acid for the chromium plating, because the current efficiency for the deposition of metallic chromium decreases remarkably. The concentration of chromic acid above 300 g/l is also not suitable from an economical point of view. The presence of additives such as fluorine compounds and sulfur compounds in the chromium plating electrolyte is indispensable for a uniform chromium deposition. If the weight % of fluoride ion or sulfate ion in the additives to chromic acid is below 1.0 or above 5.0, the current efficiency for the deposition of metallic chromium remarkably decreases, in addition to a decrease in the uniformity of the deposited metallic chromium and hydrated chromium oxide. Particularly, at below a 1.0 value for the weight % of additives to chromic acid, the formed insoluble hydrated chromium oxide in chromic acid, is formed on the metallic chromium layer and the weldability becomes remarkably poor. The amount of hydrated chromium oxide formed on the metallic chromium layer decreases with an increase in the temperature of the electrolyte. The temperature of the electrolyte above 60° C. is not suitable from an industrial point of view, because the current efficiency for the deposition of metallic chromium decreases remarkably. The temperature of the electrolyte below 30° C. is also not suitable because a large amount of hydrated chromium oxide is formed.

In some cases in the production of the surface treated steel sheet according to the present invention, the tin plated steel sheet is reflowed before the deposition of metallic chromium or electrolytic chromic acid treatment. Reflowing the tin plated steel sheet gives good effects for the adhesion of the plated tin to the steel sheet and the prevention to the increment of iron-tin alloy during heating for lacquer curing because the iron-tin alloy layer formed between the plated tin and the steel sheet acts as a barrier for the change of the plated tin to the iron-tin alloy.

The known reflowing method in which a temperature above the melting point of tin is maintained for a short time by resistance heating and/or induction heating can be used for reflowing of the tin plated steel sheet in the present invention.

It is suitable in the present invention that the tin plated steel sheet is heated to the melting point of tin to 350° C. during 0.5 to 3 seconds and then it is immediately quenched into water.

Reflowing at a higher temperature for a longer time is not desirable because of the poor weldability caused by the change of a large part of plated tin to iron-tin alloy, particularly in the case of a lower amount of plated tin.

Figure 1:
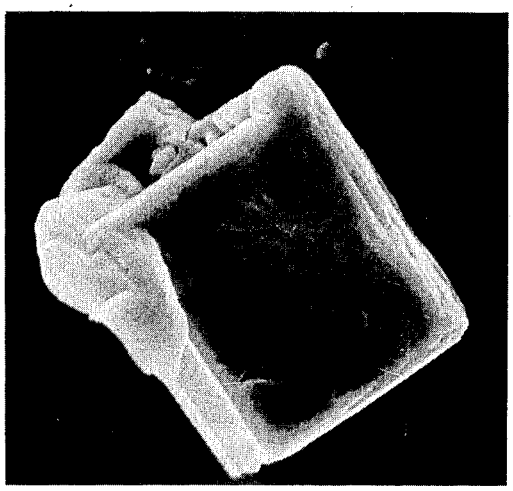
FIG. 1 shows the scanning electromicrograph of the plated granular tin under conventional tin plating conditions at a tin coating weight of 418 mg/m$^2$ which was obtained by U.S. Pat. No. 4,579,786 with a masking sheet.
Figure 2:
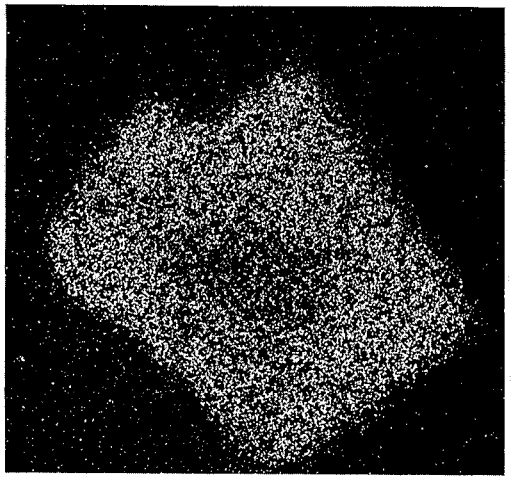
FIG. 2 shows the Sn-Kα image of the granular tin shown in FIG. 1 which was detected by EPMA (Electron Probe Micro Analysis).

After the sample shown in FIG. 1 was baked at 180° C. for 5 min. and anodically electrolyzed in 1N NaOH in order to dissolve metallic tin, the Sn-Kα image of Fe-Sn alloy of the same position shown in FIG. 1 was detected by EPMA.

Figure 3:
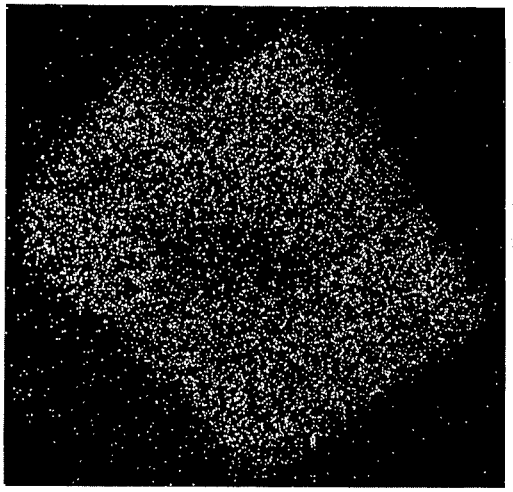

FIG. 3 shows the Sn-Kα image of the above mentioned sample.

Figure 4:
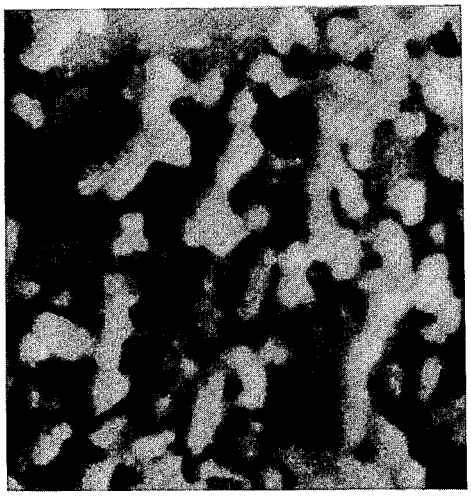

FIG. 4 shows the scanning electromicrograph of the tin plated steel sheet at a tin coating weight of 389 mg/m$^2$ obtained by the present invention.

The following are the plating conditions:

| Composition of electrolyte | |
|---|---|
| Stannous sulfate (as stannous ion) | 35 g/l |
| Phenolsulfonic acid (as $H_2SO_4$) | 18 g/l |
| Ethoxylated α-naphthol | 2 g/l |
| Temperature of electrolyte | 50° C. |

-continued

| Composition of electrolyte | |
|---|---|
| Cathodic current density | 2 A/dm$^2$ |

Figure 5:
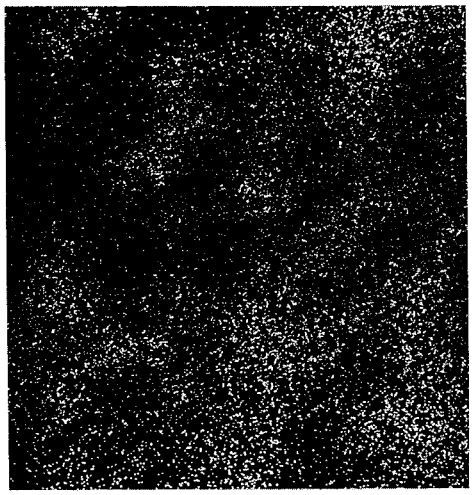

FIG. 5 shows the Sn-Kα image of tin plated steel sheet shown in FIG. 4.

After the sample shown in FIG. 4 was baked at 180° C. for 5 min. and anodically electrolyzed in 1N NaOH in order to dissolve metallic tin, the Sn-Kα image of Fe-Sn alloy of the same position shown in FIG. 4 was detected by EPMA.

Figure 6:
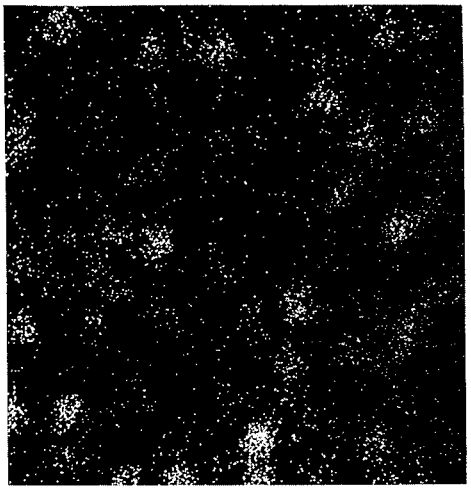

FIG. 6 shows the Sn-Kα image of the above mentioned sample.

Figure 7:
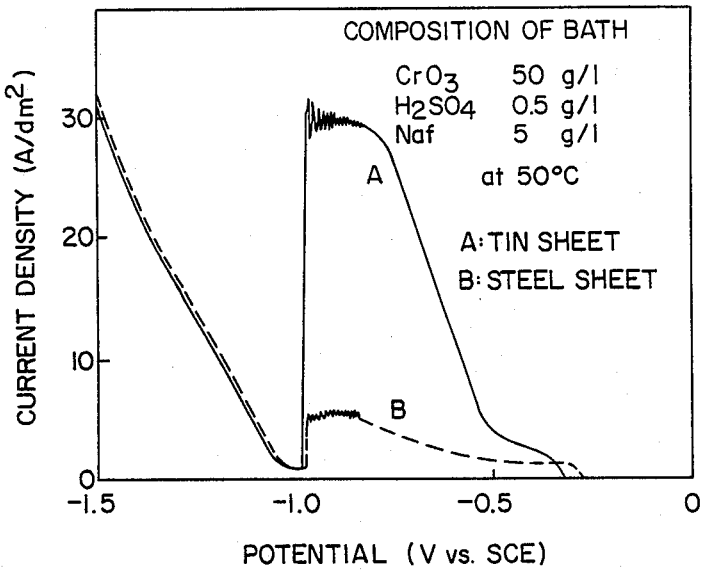

FIG. 7 shows cathodic polarization curves of a steel sheet and a tin sheet by a potentiostatic electrolysis wherein the steel sheet and the tin sheet are polarized to less potential from the rest potential of each sheet at 50 mV/min of polarization speed.

Figure 8:
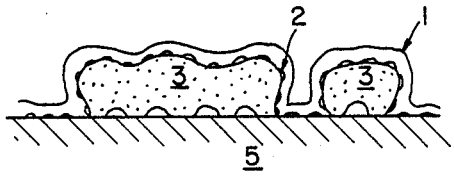
Figure 9:
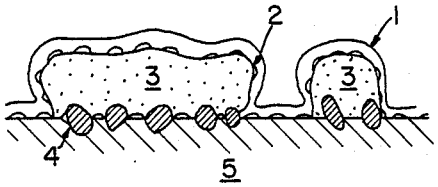

FIG. 8 and FIG. 9 show a magnified schematic diagram in cross sections of the surface treated steel sheet according to the present invention. FIG. 8 shows the state wherein the surfaces of plated tin 3 and the exposed steel base 5 are covered with metallic chromium 2 and hydrated chromium oxide 1. FIG. 9 shows the state wherein iron-tin alloy 4 is formed in the intersurface between plated tin 3 and steel base 5 by reflowing after tinplating and the surfaces of plated tin and the exposed steel base are covered with metallic chromium 2 and hydrated chromium oxide 1, the same as shown in FIG. 8.

Figure 10:
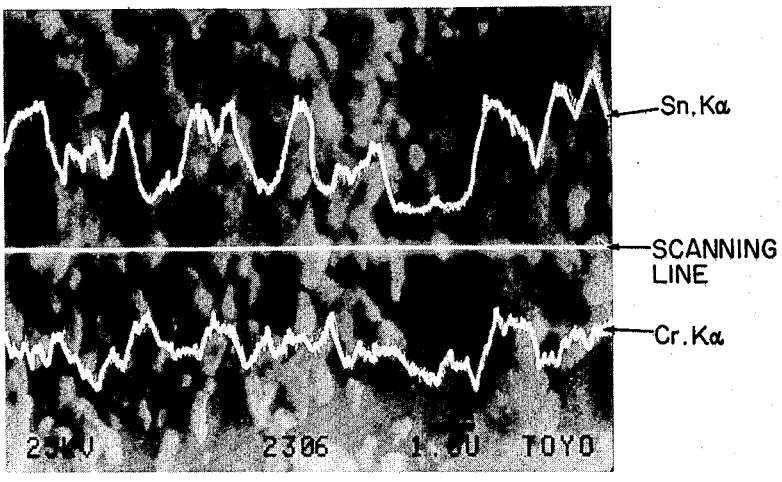

FIG. 10 shows a magnified photograph by a scanning electronmicroscope and the intensities of Sn-Kα and Cr-Kα of the surface treated steel sheet according to the present invention which is produced by the following conditions: A steel sheet was plated with 470 mg/ m$^2$ of tin under the conditions of the present invention and then it was covered with metallic chromium of 45 mg/m$^2$ and hydrated chromium oxide of 13 mg/m$^2$ as chromium by a potentiostatic electrolysis under the conditions wherein the electrode potential of the tin plated steel sheet was kept to −1.5 V vs SCE in the chromic acid electrolyte containing 50 g/l of chromic acid, 0.5 g/l of sulfuric acid and 5 g/l of sodium fluoride at 50° C. and 120 m/min of flow speed of the electrolyte. In this case, the measured cathodic current density was 30 to 32 A/dm$^2$.

Figure 11:
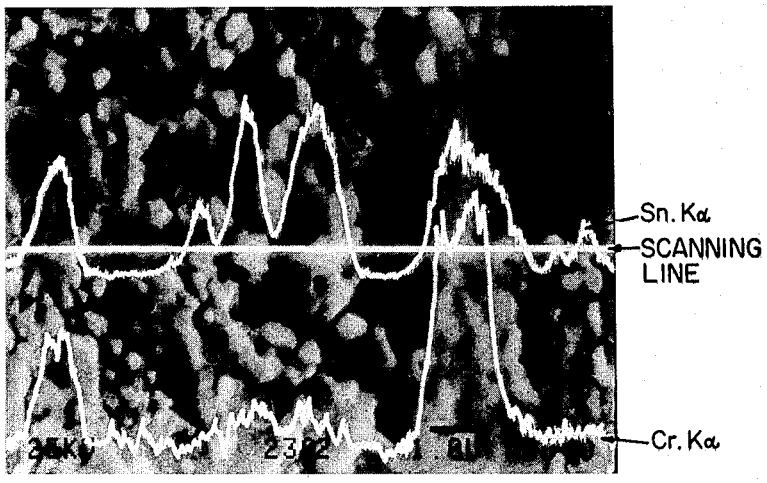

FIG. 11 also shows a magnified photograph by a scanning electronmicroscope and the intensity of Sn-Kα and Cr-Kα of the surface treated steel sheet which is produced by the following conditions: A steel sheet was plated with 470 mg/m of tin under the conditions of the present invention and then it was treated galvanostatically in the chromic acid electrolyte used for the sample of FIG. 10 under 28 A/dm$^2$ of cathodic current density. In this case, the measured electrode potential cf the tin plated steel sheet was −0.9 to −1.0 V vs SCE and the tin plated steel sheet was covered with the film having 60 mg/m$^2$ of total chromium.

In FIG. 10 and FIG. 11, a white straight line shows the scanned position for the measurement of the intensities of Sn-Kα and Cr-Kα.

The changes in the intensities of Sn-Kα and Cr-Kα were shown in the upper part and lower part of the scanning line, respectively.

In FIG. 10 and FIG. 11, it was found from the change of the intensity of Sn-Kα that the white part was the tin plated part and the black part was the exposed steel surface after tinplating.

Furthermore, it was found from the change of the intensity of Cr-Kα that a film containing chromium was uniformly formed on the plated tin and the exposed steel surface in FIG. 10 and a thicker film containing chromium was formed only on the plated tin in FIG. 11.

By using a known chemical method in which hydrated chromium oxide was dissolved in an alkali hydroxide solution, it was found the film containing chromium consists of metallic chromium and hydrated chromium oxide in FIG. 10 and only hydrated chromium oxide in FIG. 11.

EXAMPLES OF THE PRESENT INVENTION

The present invention is illustrated by the following Examples.

In Example 1 to Example 7 and Comparative Example 1 to Comparative Example 7, a cold rolled steel sheet having a thickness of 0.21 mm was basically treated by the following process after electrolytically degreasing in a solution of 70 g/l of sodium hydroxide under 10 A/dm$^2$ of cathodic current density for 2 seconds at 70° C., water rinsing, pickling by an immersion into 70 g/l of sulfuric acid for 3 seconds at 25° C. and then water rinsing.

In Example 1 to Example 5 and Comparative Example 1 to Comparative Example 5, a steel sheet pretreated under the conditions described above was treated by the following process:

Tinplating→water rinsing→formation of metallic chromium and hydrated chromium oxide→water rinsing→drying.

In Example 6 and Example 7, chromium plating was carried out after tinplating and then hydrated chromium oxide was formed.

In Comparative Example 6 which shows an example of electrotinplate, tin plated steel sheet was treated by using sodium dichromate solution. In Comparative Example 7 which shows an example of tin free steel, a steel sheet was directly treated by chromic acid solution containing additives.

In Example 2, Example 4, Example 7, Comparative Example 2, Comparative Example 4 and Comparative Example 6, the tin plated steel sheet was immediately quenched in water after raising the temperature of the tin plated steel sheet to 280° C. during 1.6 seconds before chromium plating or electrolytic chromic acid treatment. In Comparative Example 5, nickel is plated on a steel sheet by using a Watt's bath containing 250 g/l of $NiSO_4 \cdot 6H_2O$, 30 g/l of $NiCl_2 \cdot 6H_2O$ and 40 g/l of $H_3BO_3$ under 5 A/dm$^2$ of cathodic current density at 40° C.

Furthermore, phenolsulfonic acid as the acid and ethoxylated α-naphthol as the additive in the tinplating electrolyte are respectively used in Example 1 to Example 7 and Comparative Example 1 to Comparative Example 6.

In each Example and Comparative Example, the conditions for tinplating, chromium plating and electrolytic chromic acid treatment are shown in detail in the Table.

The weldability and lacquer adhesion of the thus treated steel sheet in the above described Examples and Comparative Examples were evaluated by the following testing methods after the measurement of the amounts of plated nickel, plated tin, metallic chromium and chromium in hydrated chromium oxide by the fluorescent X-ray method, the results of which are shown in the attached Table.

(1) Weldability

The weldability is evaluated by an available range of secondary current in welding as shown in the report by N. T. Williams (Metal Construction, April 1977, pages 157–160), that is to say, the wider the secondary current range in welding, the better the weldability. The upper limit in the available secondary current range corresponds to the welding conditions in which some defect such as splashing is found and the lower limit corresponds to the welding conditions in which the breakage occurs in the welded part tearing tests.

In order to obtain data wherein the available range of secondary current in welding is decided in each sample, large amounts of samples are necessary.

Therefore, the weldability was evaluated by an electric contact resistance according to the following method, because an electric contact resistance has an apparent correlation with an available range of secondary current in welding as shown in the report by T. Fujimura (Journal of the Iron and Steel Institute of Japan, Vol. 69, No. 13, September 1983, page 181), that is, the lower the electric contact resistance, the wider the secondary current range in welding. Accordingly, if the electric contact resistance is lower, the weldability is better.

At first, the sample was treated on both sides cut to a size of 20 mm×100 mm after baking at 210° C. for 20 minutes. The electric contact resistance of the sample was calculated from the change of voltage in a pair of copper disk electrodes (diameter: 65 mm, thickness: 2 mm) to which 5 amperes of direct current were supplied and 50 kg of load was added, when two sample pieces were inserted between a pair of the copper disk electrodes rotating at 5 m/min..

(2) Lacquer adhesion

The sample was baked at 210° C. for 12 minutes after coating with 50 mg/dm$^2$ of an epoxy-phenolic type of lacquer. The two coated sample pieces, which were each cut to a size of 5 mm×150 mm, were bonded together using a nylon adhesive having a thickness of 100 μm at 200° C. for 30 seconds under 3 kg/cm$^2$ of pressure by a Hot Press.

The bonding strength of the assembly, which is shown as kg/5 mm, was measured by a conventional tensile testing machine.

We claim:

1. A surface treated steel sheet having double layers consisting of a lower layer of metallic chromium and an upper layer of hydrated chromium oxide on a low tin plated steel sheet wherein 30 to 80% of the surface of the steel sheet is covered with plated tin and the effect diameter of an irregularly shaped unplated area, which is defined as the diameter of a circle having the identical area, is between 0.5 and 20 μm and the ratio of the area of tin, which is the projected area of plated tin to the steel sheet, the ratio of the area which is actually combined with the steel sheet to the projected area is 20 to 90%, which is produced by a process which comprises:

tin plating at a temperature of 40° to 60° C. and under a cathodic current density of 2 to 10 A/dm$^2$ in a stannous sulfate electrolyte or stannous phenolsulfonate electrolyte containing 30 to 80 g/l of stannous ion, 15 to 60 g/l of acid as sulfuric acid and 0.2 to 2 g/l of an α-naphthol additive, chromium plating on the Sn plated steel sheet after reflowing or without reflowing the tin plated steel sheet at a temperature of 30° to 60° C. and under higher current density than that shown when the electrode potential of the tin plated steel sheet is kept at −0.8 to 1.0 V versus a saturated calomel electrode in an electrolyte containing 100 to 300 g/l of chromic acid and at least one additive selected from the group consisting of a fluorine compound and a sulfur compound with the amount of fluoride ion or sulfate ion in said additive being 1 to 5 weight % of chromic acid, and forming on the resultant steel sheet, a layer of hydrated chromium oxide by using an electrolyte containing 30 to 100 g/l of chromic acid and at least one additive selected from the group consisting of a fluorine compound and sulfur compound, with the amount of fluoride ion or sulfate ion in said additive being 1 to 5% of chromic acid wherein the amount of the plated tin is 50 to 900 mg/m$^2$, the amount of metallic chromium in the lower layer of said double layers is 7 to 100 mg/m$^2$ and the amount of hydrated chromium oxide in the upper layer of said double layers is 5 to 50 mg/m$^2$ as chromium.

2. A surface treated steel sheet having double layers consisting of a lower layer of metallic chromium and an upper layer of hydrated chromium oxide on a low tin plated steel sheet wherein 30 to 80% of the surface of the steel sheet is covered with plated tin and the effective diameter of an irregularly shaped unplated area, which is defined as the diameter of a circle having the identical area, is between 0.5 and 20 μm and the ratio of the area of tin, which is the projected area of plated tin to the steel sheet, the ratio of the area which is actually combined with the steel sheet to the projected area is 20 to 90%, which is produced by a process which comprises:

tin plating at a temperature of 40° to 60° C. and under a cathodic current density of 2 to 10 A/dm$^2$ in a stannous sulfate electrolyte or stannous phenolsulfonate electrolyte containing 30 to 80 g/l of stannous ion, 15 to 60 g/l of acid as sulfuric acid and 0.2 to 2 g/l of an α-naphthol additive, forming said double layers on the tin plated steel sheet after reflowing or without reflowing the tin plated steel sheet at a temperature of 30° to 60° C. and under higher current density than that when the electrode potential of the tin plated steel sheet is kept at −0.8 to −1.0 V versus a saturated calomel electrode in an electrolyte containing 30 to 100 g/l of chromic acid and at least one additive selected from the group consisting of a fluorine compound and a sulfur compound with the amount of fluoride ion or sulfate ion in said additive being 1 to 5 weight% of chromic acid wherein the amount of the plated tin is 50 to 900 mg/m$^2$, the amount of metallic chromium in the lower layer of said double layers is 7 to 100 mg/m$^2$ and the amount of hydrated chromium oxide in the upper layer of said double layers is 5 to 50 mg/m$^2$ as chromium.

3. The surface treated steel sheet according to claim 1 or claim 2, wherein the amount of the plated tin is 100 to 600 mg/m$^2$, the amount of metallic chromium in the lower layer of said double layers is 20 to 70 mg/m$^2$ and the amount of hydrated chromium oxide in the upper layer of said double layers is 7 to 30 mg/m$^2$ as chromium.

4. The surface treated steel sheet according to claim 1 or claim 2, wherein said fluorine compound is at least one compound selected from the group consisting of hydrofluoric acid, fluoboric acid, fluosilicic acid, ammonium bifluoride, an alkali metal bifluoride, ammonium fluoride, an alkali metal fluoborate, ammonium fluosilicate, an alkali metal fluosilicate and aluminum fluoride.

5. The surface treated steel sheet according to claim 1 or claim 2, wherein said sulfur compound is at least one compound selected from the group consisting of sulfuric acid, ammonium sulfate, an alkali metal sulfate, chromium sulfate, ammonium sulfite, an alkali metal sulfite, ammonium thiosulfate and an alkali metal thiosulfate.

* * * * *